US005994827A

United States Patent [19]

Kim et al.

[11] Patent Number: 5,994,827

[45] Date of Patent: Nov. 30, 1999

[54] FOCUSING ELECTRODE STRUCTURE

[75] Inventors: Hyun Cheol Kim; Gyeong Sang Lee; Sung Gi An, all of Kyungsangbuk-do, Rep. of Korea

[73] Assignee: LG Electronics Inc., Rep. of Korea

[21] Appl. No.: 08/954,967

[22] Filed: Oct. 21, 1997

[30] Foreign Application Priority Data

Oct. 21, 1996 [KR] Rep. of Korea ..... 96-47105

[51] Int. Cl.[6] ..... H01J 29/51

[52] U.S. Cl. ..... 313/414; 313/412; 313/460

[58] Field of Search ..... 313/412, 413, 313/414, 449, 479, 437, 432, 460, 436, 448; 315/382, 382.1, 14, 15

[56] References Cited

U.S. PATENT DOCUMENTS 4,887,009 12/1989 Bloom et al. ..... 313/414
5,384,512 1/1995 Kamohara et al. ..... 313/414

*Primary Examiner*—Vip Patel
*Assistant Examiner*—Joseph Williams
*Attorney, Agent, or Firm*—Fish & Richardson P.C.

[57] ABSTRACT

A focusing electrode in an electron gun for a color cathode ray tube or high definition industrial picture tube includes a first and second focusing electrodes. A recess portion in one end of the first focusing electrode is oriented to face burring parts of the second focusing electrode. An electron beam and a surrounding portion pass through holes in the first focusing electrode to reduce the space between the first and second focusing electrodes. This improves the static convergence drift.

7 Claims, 4 Drawing Sheets

FOCUSING ELECTRODE STRUCTURE

BACKGROUND OF THE INVENTION

1. Field of the Invention

The present invention is related to an electron gun for use in a color cathode ray tube or high definition industrial picture tube, and more particularly, to a structure of a focusing electrode in an electron gun for a color cathode ray tube, in which a gap between first and second focusing electrodes can be arranged closer for improving an STC (Static Convergence Drift) occurred during operation of the electron gun.

2. Discussion of the Related Art

The electron gun is a device in which three electron beams emitted from cathodes are focused on a fluorescent screen consisting of red, green and blue fluorescent materials coated on an inside surface of the cathode ray tube. Each of the fluorescent materials reacts with one of the electron beams to emit a fluorescent light with, a combination of the three beams forming a pixel.

FIG. 1 illustrates a cross section of a general in-line type electron gun.

Referring to FIG. 1, the electron gun 1 includes a triode 2 and main focusing static lens 3. The triode 2 has cathodes 4 each for emitting thermal electrons toward a screen, a control electrode 5 for controlling the thermal electrons, and an accelerating electrode 6 for accelerating the thermal electrons, arranged in the aforementioned order. The main focusing static lens 3 arranged in front of triode 2 has a focusing electrode 7 and an anode 8. When voltages of preset levels different from one another are applied to the different electrodes respectively, the electron beams are controlled and focused into intended intensities by the controlling electrode 5 and the accelerating electrode 6, focused by a main focusing static lens formed between the focusing electrode 7 and the anode 8, and accelerated by the anode 8 toward the screen. Then, the electron beams are deflected by a non-uniform magnetic field formed by deflection yokes to make a self convergence, and form a pixelon the screen. However, the application of the non-uniform magnetic field causes the electron beams to form a horizontally elongated spot together with haze. Haze is a thinning of an image on upper and lower sides of the horizontally elongated spot caused by a synergy effect of the focusing power of the magnetic field which is weak in horizontal the direction and strong in the vertical direction. The haze can be eliminated or reduced by forming a well known dynamic four polar correcting lens between a divided focusing lens upon application of a voltage synchronous to a deflection signal to one of the divided focusing lens.

FIG. 2 illustrates a perspective view of a disassembled conventional focusing lens divided into two to form the dynamic four polar correcting lens.

Referring to FIG. 2, the focusing electrode 7 includes a first focusing electrode 71 adapted to be applied of a static voltage, a second focusing electrode 72 arranged next to the first focusing electrode 71 and adapted to be applied of a dynamic voltage for producing a voltage difference higher than the voltage to the first focusing lens 71 in a range of 300~1000 V depending on extent of deflection of the electron beams, electron beam pass through holes 711 and 721 formed in the first and second focusing lenses 71 and 72 at facing end surfaces 712 and 722, and a pair of burring parts 723 at an upper and a lower portions of each of the electron beam pass through holes 721 in the second focusing electrode 72 projected toward or inserted in one of the electron beam pass through holes 711 in the first focusing electrode 71. With this configuration, when the electron beams are deflected, the second focusing electrode 72 is applied of the dynamic voltage to form the dynamic four polar correcting lens between the first and second focusing lenses 71 and 72 by the voltage difference formed between them. The burring parts 723 provided at the upper and lower portions of the electron beam pass through holes 721 in the second focusing electrode 72 permitting the dynamic four polar correcting lens to correct the horizontal elongation of the electron beam spot. However, as shown in FIG. 3 A, during formation of the burring parts 723, stresses are generated at a circumference of the electron beam pass through holes 721 where the burring parts 723 are not provided, resulting in cracks 724 therein, that reduce the performance of the electron beams. FIG. 3B illustrates low burring parts 723L provided at horizontal portions of the electron beam pass through holes 721 for preventing generation of the cracks at the circumference of the electron beam pass through holes 721 in the second focusing electrode 72. Because of the added length of low burring parts 723L, the length of the high burring part 723H is lengthened as much as the length of the low burring part 723L to offset the influence from the low burring part 723L, which causes a gap D between the first and second focusing electrodes 71 and 72 to become greater as much as the length of the low burring part 723L as shown in FIG. 3C. The gap D between the first and second focusing electrodes 71 and 72 should be maintained to be in a range of 0.5 mm~0.6 mm. If the gap D is smaller than 0.5 mm, discharges can occur, and if the gap is greater than 0.6 mm, an STC drift, in which variation of focusing of the electron beams takes place as time changes may occur. According to a test room experiment, if the gap D between the first and second focusing electrodes 71 and 72 is greater than 0.8 mm, the electron beams are affected negatively. When the low burring part 723L is provided, the gap D between the first and second focusing electrodes 71 and 72 is in general greater than 0.8 mm.

SUMMARY OF THE INVENTION

Accordingly, the present invention is directed to a structure of a focusing electrode in an electron gun for a color cathode ray tube that substantially obviates one or more of the problems due to limitations and disadvantages of the related art.

The invention provides a focusing electrode in an electron gun for a color cathode ray tube which can eliminate a static convergence drift caused by low burring parts.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the structure of a focusing electrode in an electron gun for a color cathode ray tube includes a recess portion in one end of a first focusing electrode oriented to face burring parts, the recess portion being recessed in a cathode direction by an extent capable to accommodate an increased length of the burring parts and having electron beam pass through holes in the first focusing electrode and a portion around the electron beam pass through holes in the first focusing electrode.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Figure 1:
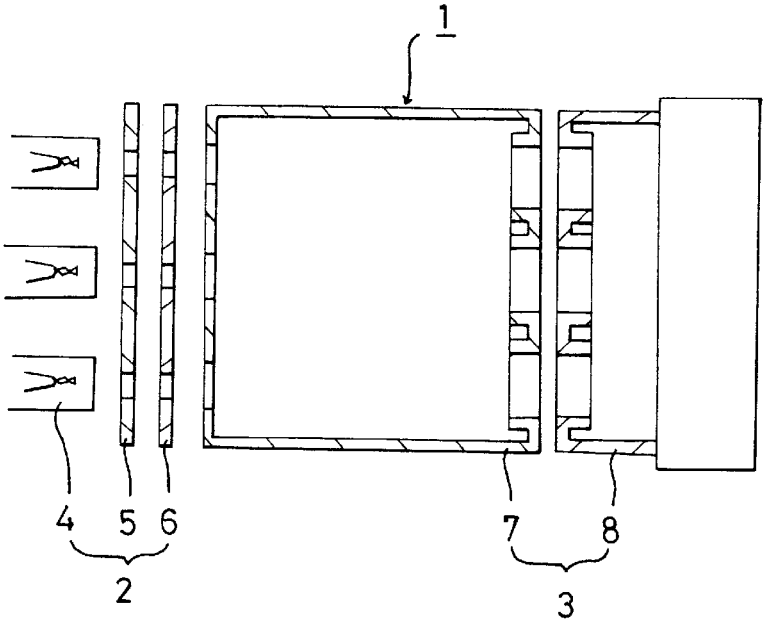
FIG. 1 Prior Art
FIG. 1 illustrates a schematic cross section showing a configuration of an electron gun in a general color cathode ray tube.
Figure 2:
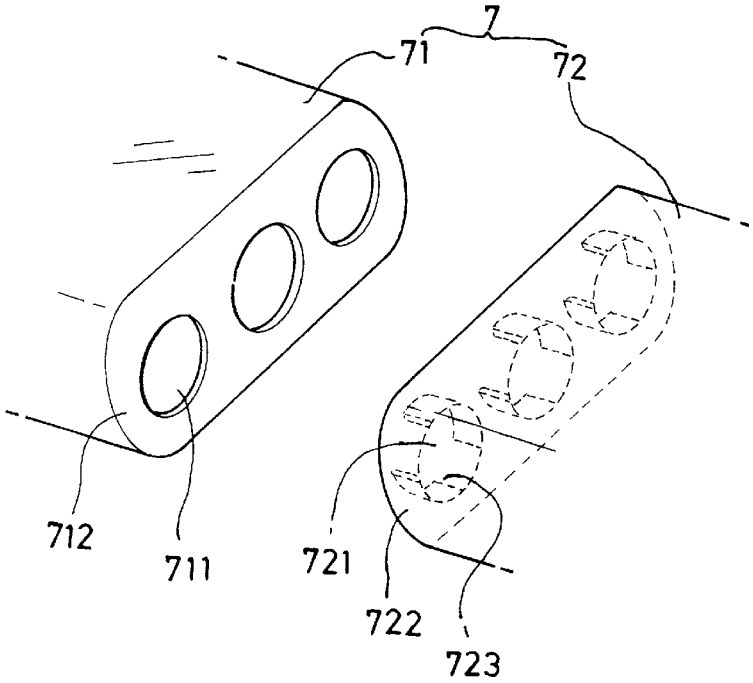
FIG. 2 Prior Art
FIG. 2 illustrates a perspective view of conventional first and second focusing electrodes which is a division of the focusing electrode shown in FIG. 1.
Figure 3A:
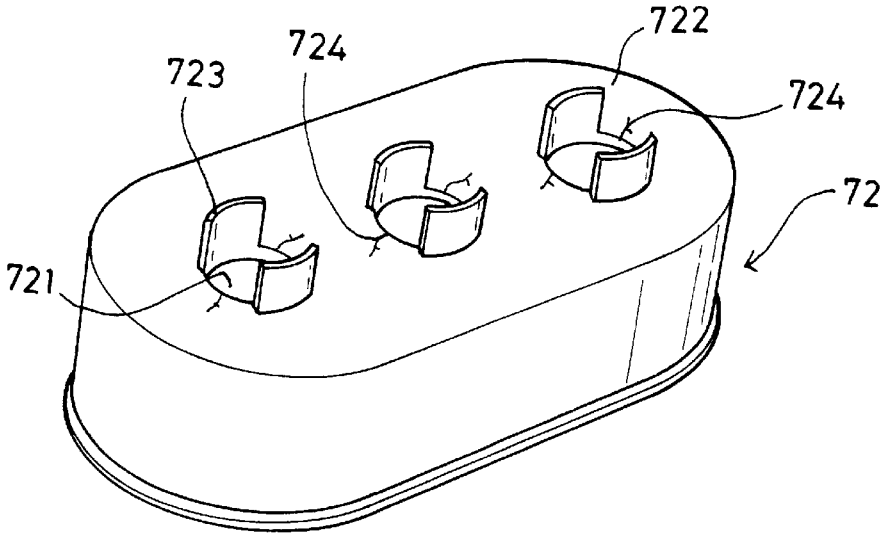
FIG. 3A Prior Art
FIG. 3A illustrates a perspective view of the second focusing electrode shown in FIG. 2 showing cracks occurring therein.
Figure 3B:
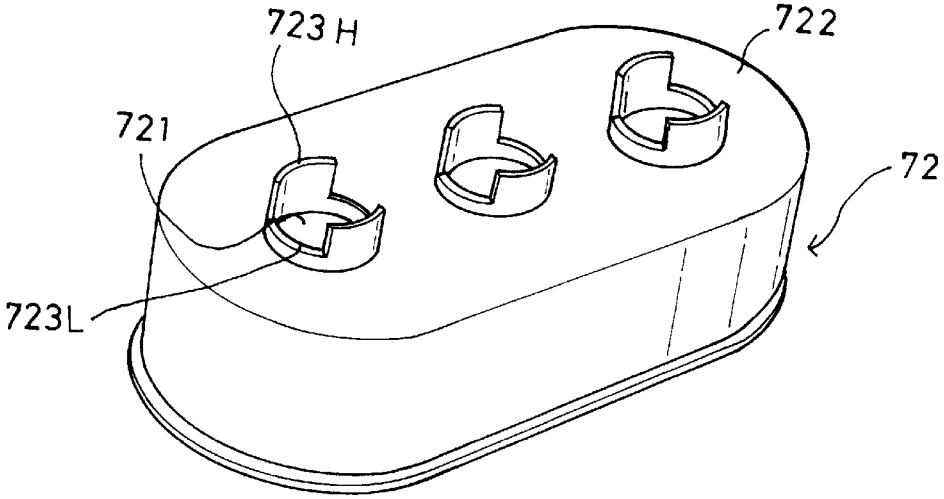
FIG. 3B Prior Art
FIG. 3B illustrates a perspective view of the second focusing electrode showing low burring parts and high burring parts instead of the burring parts on the second focusing electrode shown in FIG. 3A for preventing occurrence of the cracks in the second focusing electrode.
Figure 3C:
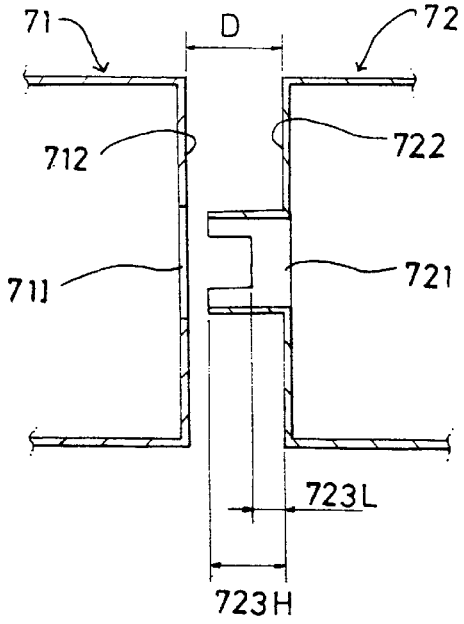
FIG. 3C Prior Art
FIG. 3C illustrates a cross section of the first and second focusing electrodes showing the widened gap between the first and second focusing electrodes with the burring parts on the second focusing electrode replaced with the low burring parts and the high burring parts.
Figure 4:
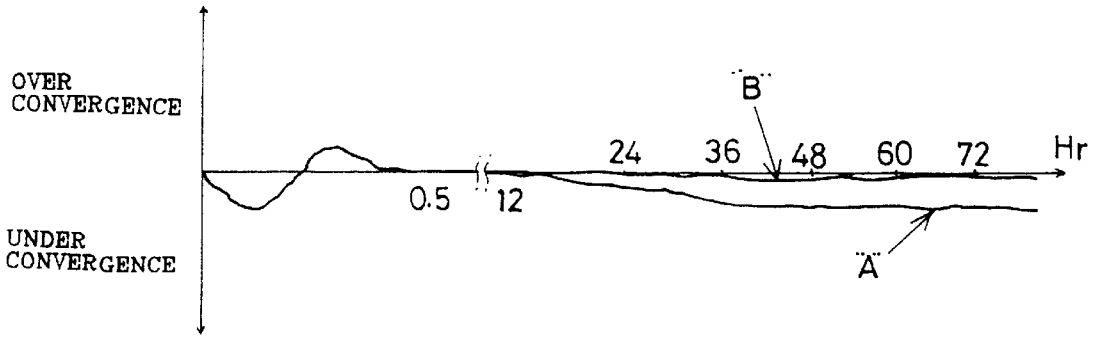
FIG. 4 illustrates a graph showing STC drift vs. time in an electron gun of the present invention and the conventional art.
Figure 5A:
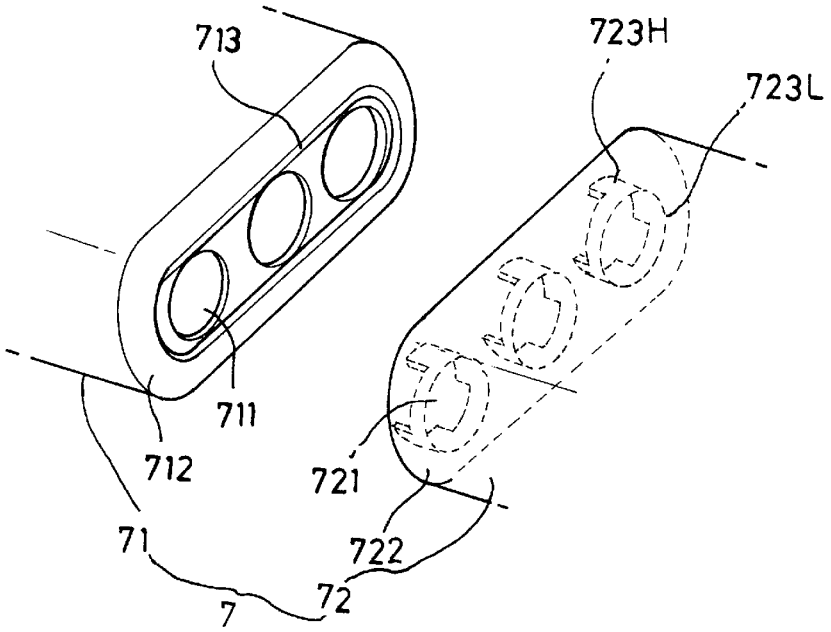
FIG. 5A illustrates a perspective view of focusing electrodes in an electron gun in accordance with a preferred embodiment of the present invention; and, FIG. 5B illustrates a cross section of the focusing electrodes shown in FIG. 5A.

Reference will now be made in detail to the preferred embodiments of the present invention, examples of which are illustrated in the accompanying drawings. FIG. 5A illustrates a perspective view of a focusing electrode in an electron gun in accordance with a preferred embodiment of the present invention, wherein parts identical to the conventional art are given identical reference numbers.

Figure 5B:
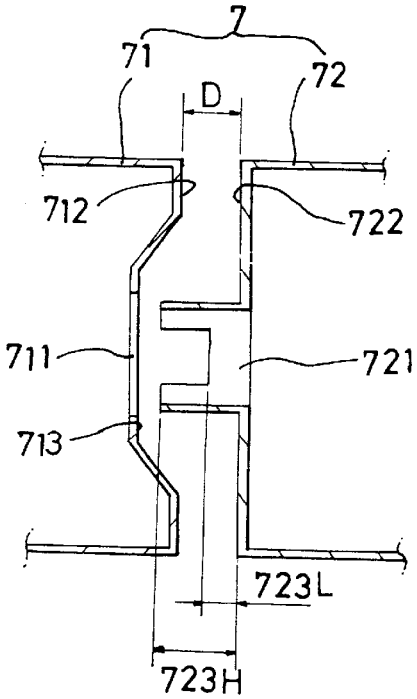

Referring to FIG. 5A, focusing electrode 7 of the present invention is next to a triode which forms three electron beams includes a first focusing electrode 71 adapted to be applied of a static voltage, a second focusing electrode 72 disposed next to the first focusing electrode 71 and adapted to be applied of a dynamic voltage depending on an extent of deflection of the electron beams by the deflection yokes, projections 723H and 723L formed at a circumference of each of three electron beam pass through holes 721 in one end 722 of the second focusing electrode 72 disposed to face the first focusing electrode 71, and a recess portion 713 in one end 712 of the first focusing electrode 71 disposed to face the projections 723H and 723L including three electron beam pass through holes 711 in the first focusing electrode 71 and a portion around the three electron beam pass through holes 711. The projections are preferably formed by burring. The projections have a pair of low burring parts 723L formed in left and right portions of the electron beam pass through hole 711 and a pair of high burring parts 723H formed in upper and lower portions of the electron beam pass through hole 711 such that a length of the projection of each of the high burring parts 723 is longer than a length of the projection of each of the low burring parts 723L, for forming a dynamic four polar correcting lens between the first and second focusing electrodes 71 and 72 while preventing occurrence of cracks at a circumference of each of the electron beam pass through holes 721 in the second focusing electrode 72 while correcting the horizontal elongation of the electron beam spot. A portion of each of the high burring parts 723H is inserted in the recess portion 715 for offsetting a portion of the gap increased by the low burring parts 723L. FIG. 5B illustrates a cross section of the focusing electrodes shown in FIG. 5A, wherein the recess portion 715 in the first focusing electrode is clearly shown. If the high burring part 723H has a length of 0.8 mm, the low burring part 723L has a length of 0.3 mm, and the recess 715 has a depth of 0.3 mm, it can be known that the recess portion 713 accommodates the increased portion of the length of the low burring parts 723L. Therefore, the gap D between the first, and second focusing electrodes can be reduced to 0.5 mm which is the gap that can prevent occurrence of discharge and STC drift. The STC drift characteristic of the present invention is stable in comparison to the STC drift in the conventional art.

The present invention can maintain the STC drift stable as the gap between the first and second focusing lenses is increased due to the low burring parts. This gap can be reduced by recessing the electron beam pass through holes in the first focusing electrode in a cathodes direction.

It will be apparent to those skilled in the art that various modifications and variations can be made in a structure of a focusing electrode in an electron gun for a color cathode ray tube of the present invention without departing from the spirit or scope of the invention. Thus, it is intended that the present invention cover the modifications and variations of this invention provided they come within the scope of the appended claims and their equivalents.

What is claimed is:

1. A focusing electrode structure in an electron gun for a color cathode ray tube, the structure comprising:

a first focusing electrode adapted to have applied a static voltage and a second focusing electrode adapted to have applied a dynamic voltage based on the extent of deflection of electron beams;

a projection formed on a circumference of each of three electron beam pass through holes formed in the second focusing electrode on an end surface thereof oriented to face the first focusing electrode; and a recess portion recessed from one end of the first focusing electrode and oriented to be recessed away from the projection formed on the circumference of an electron beam pass through hole of the second focusing electrode, the recess portion being recessed in a cathode direction and including three electron beam pass through holes in the first focusing electrode and a portion around the three electron beam pass through holes in the first focusing electrode.

2. A structure as claimed in claim 1, wherein each of the projections are formed by burring.

3. A structure as claimed in claim 2, wherein each of the projections has a projection length on an upper and a lower portions of each of the first electron beam pass through holes longer than a projection length on a left and right portions of each of the first electron beam pass through holes.

4. A structure as claimed in claim 3, wherein each of the projections includes a vertical portion having a pair of an upper and a lower burring parts and a horizontal portion having a pair of left and right burring parts.

5. A structure as claimed in claim 1, wherein a portion of each of the projections is inserted in the recess portion.

6. The focusing electrode structure of claim 1, wherein the first focusing electrode includes an outer perimeter surface facing the second focusing electrode, and the recess portion is surrounded by the outer perimeter surface and further from the second focusing electrode than the outer perimeter surface.

7. The focusing electrode structure of claim 6, wherein the outer perimeter surface comprises a continuous, planar surface.

* * * * *